US008075187B2

(12) United States Patent
Bois et al.

(10) Patent No.: US 8,075,187 B2
(45) Date of Patent: Dec. 13, 2011

(54) CLOSURE KIT FOR A BAG COMPRISING MEANS PREVENTING A CURSOR FROM BEING TORN OFF AND FITTED BAG

(75) Inventors: Henri Georges Bois, Neuilly sur Seine (FR); Philippe Eggermont, Champagne sur Oise (FR)

(73) Assignee: S2F Flexico, Henonville (FR)

( * ) Notice: Subject to any disclaimer, the term of this patent is extended or adjusted under 35 U.S.C. 154(b) by 1007 days.

(21) Appl. No.: 10/557,780

(22) PCT Filed: May 7, 2004

(86) PCT No.: PCT/FR2004/001114

§ 371 (c)(1),
(2), (4) Date: Nov. 17, 2005

(87) PCT Pub. No.: WO2004/103842

PCT Pub. Date: Dec. 2, 2004

(65) Prior Publication Data

US 2006/0218760 A1 Oct. 5, 2006

(30) Foreign Application Priority Data

May 19, 2003 (FR) ..... 03 05988

(51) Int. Cl.
*B65D 33/16* (2006.01)
*A44B 1/04* (2006.01)

(52) U.S. Cl. ..... 383/64; 24/399

(58) Field of Classification Search ..... 24/585.12, 24/399, 400; 383/63, 64
See application file for complete search history.

(56) References Cited

U.S. PATENT DOCUMENTS

| | | | | |
|---|---|---|---|---|
| 5,007,142 | A * | 4/1991 | Herrington | 24/585.12 |
| 5,664,299 | A | 9/1997 | Porchia et al. | |
| 6,247,844 | B1 * | 6/2001 | Tomic et al. | 383/64 |
| 6,461,042 | B1 * | 10/2002 | Tomic et al. | 383/64 |
| 6,698,926 | B2 * | 3/2004 | Buchman | 383/64 |
| 6,739,755 | B2 * | 5/2004 | Schreiter | 383/64 |
| 6,786,641 | B2 * | 9/2004 | Plourde | 383/64 |
| 6,826,808 | B2 * | 12/2004 | Kutschka | 24/427 |
| 6,915,546 | B2 * | 7/2005 | Kasai | 24/30.5 R |
| 7,097,359 | B2 * | 8/2006 | Plourde et al. | 383/63 |
| 7,165,292 | B2 * | 1/2007 | Kasai | 24/30.5 R |
| 7,416,338 | B2 * | 8/2008 | Ausnit | 383/64 |
| 7,461,434 | B2 * | 12/2008 | Ackerman | 24/30.5 R |
| 7,574,782 | B2 * | 8/2009 | Ackerman | 24/400 |
| 2003/0235351 | A1 * | 12/2003 | Plourde | 383/64 |

FOREIGN PATENT DOCUMENTS

| | | | |
|---|---|---|---|
| EP | 0941937 | A | 9/1999 |
| EP | 1873072 | A2 * | 1/2008 |
| WO | WO 03/022697 | A1 | 3/2003 |

* cited by examiner

*Primary Examiner* — Jes F Pascua
(74) *Attorney, Agent, or Firm* — Blakely, Sokoloff, Taylor & Zafman

(57) ABSTRACT

The invention relates to 2 closure kit comprising two extra elements (200, 250) which can successively engaged and separated, and a cursor (100) comprising a base (110), two lateral side plates (120, 130), a central wall (140) and a sole (142) linked to the central wall (140), characterized in that at least one of the two elements (200, 250) comprises a structure (210, 260) forming a stop for the sole (242) in order to prevent doe cursor (100) from retreating as a result of the effect of a stair tending towards tearing.

9 Claims, 3 Drawing Sheets

Figure 1:
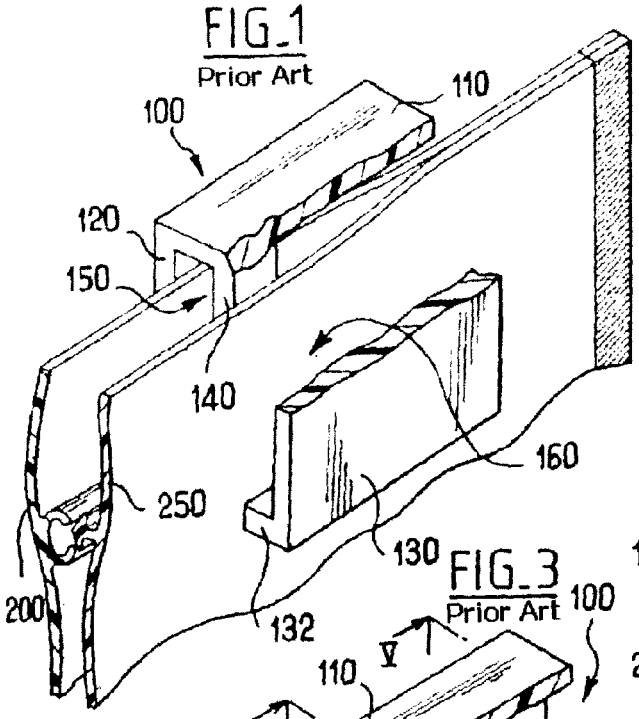
FIG. 1 Prior Art

CLOSURE KIT FOR A BAG COMPRISING MEANS PREVENTING A CURSOR FROM BEING TORN OFF AND FITTED BAG

The present patent application is a non-provisional application of International Application No. PCT/FR2004/001114, filed May 7, 2004.

BACKGROUND OF THE INVENTION

1. Field of the Invention

The present invention relates to the field of bags comprising closure devices actuated by a cursor.

2. Description of Related Art

Many devices of this type have already been proposed.

Bag closure devices usually comprise two complementary male/female type shaped elements or complementary hook type elements designed to allow multiple successive openings/closures.

The purpose of the cursor is to make the respective engagement and separation of the profiled elements easier.

The appended FIGS. 1 to 5 show a closure device with a cursor according to the prior art.

As can be seen in these figures, the cursor 100 usually comprises a base 110 which supports two side plates 120, 130 and a central wall 140. The plates 120, 130 and the wall 140 together define two channels 150, 160 at least partly nonparallel. These channels receive respective elements connected to the two profiled elements 200, 250.

The known cursors have already done great service. They make it easier to open and close bags since it is sufficient to move the cursor, according to the direction of movement thereof, in order to separate or engage the profiled elements due to the fact that the channels 150, 160 are not parallel.

However, the bags thus fitted have a serious disadvantage: it is noted that the cursors are sometimes torn off and particularly there is a risk of swallowing by children.

To try to reduce this risk, it has already been proposed, as shown in the appended figures, to place on the free edges of the plates 120, 130, longitudinal ribs 122, 132 intended to position themselves beneath the profiled elements. However, this measure is insufficient. In the event of a powerful force being applied to the cursor, the plates 120, 130 are separated and the cursor torn off.

BRIEF SUMMARY OF THE INVENTION

Figure 3:
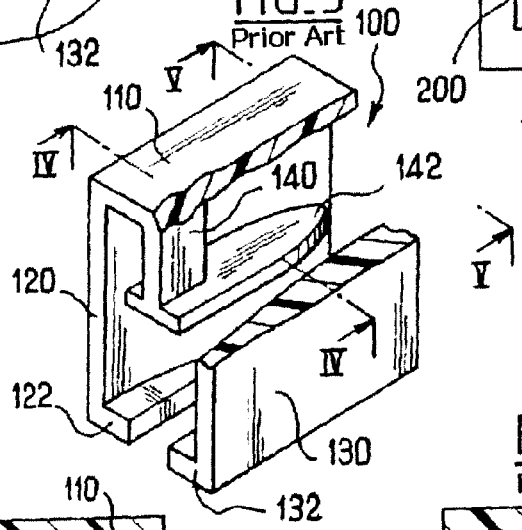
FIG. 3 Prior Art
Figure 4:
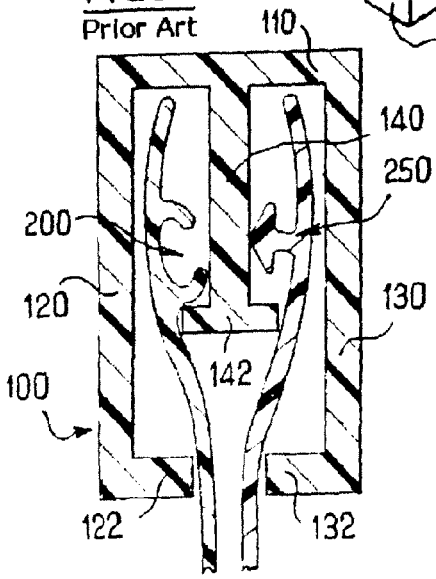
FIG. 4 Prior Art
Figure 5:
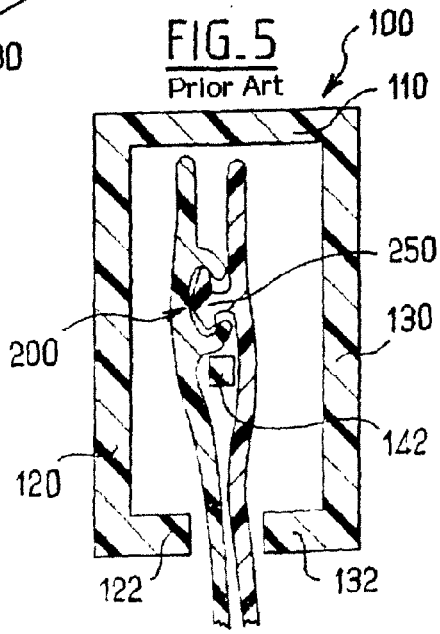
FIG. 5 Prior Art

As illustrated in FIGS. 3, 4 and 5, a proposal has also been made to place a sole 142 on the end of the central wall 142. The sole 142 is intended to position itself beneath the profiled elements 200, 250 as can be seen in FIGS. 4 and 5. However, here again, this solution is not totally satisfactory. Specifically, the sole 142 must have a shape that tapers in the direction of the convergence of the channels 150, 160 so as not to disrupt the closure of the bag. Thus in practice it is noted that the risk of tearing the cursor off remains, particularly by pivoting and extracting via the tapered end of the sole that acts like a wedge forcing the profiled elements apart.

The object of the present invention is to enhance the known devices while limiting the risk of the cursor being-torn off.

This object is achieved in the context of the present invention thanks to a closure kit comprising two complementary elements capable of being successively engaged and separated, and a cursor comprising a base, two side plates, a central wall and a sole connected to the central wall, characterized in that at least one of the two elements has a structure that is concave toward the inside of the bag forming a stop for the sole to prevent the cursor being pulled off under the effect of a tearing action.

The present invention also relates to bags fitted with such a closure kit.

BRIEF DESCRIPTION OF THE SEVERAL VIEWS OF THE DRAWING(S)

Figure 2:
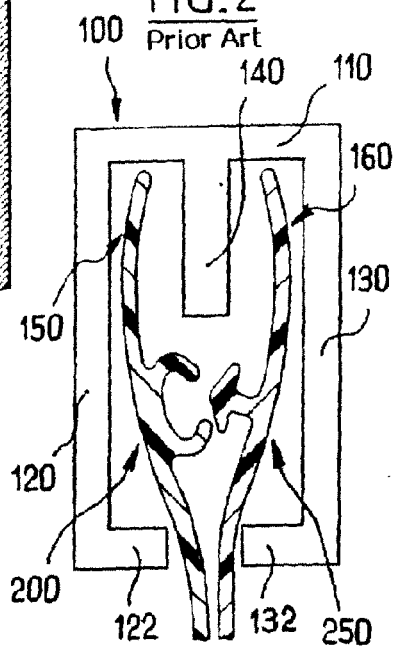
FIG. 2 Prior Art
Figure 6:
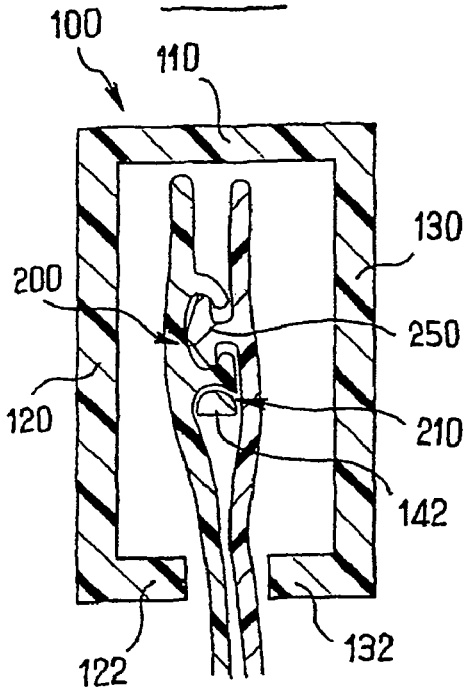

Other features, objects and advantages of the present invention will appear on reading the-detailed description that follows, with respect to the appended drawings which are given as nonlimiting examples and in which:

FIG. 1, previously described, represents a schematic view in perspective, partially exploded, of a known closure kit according to the prior art, FIG. 2, previously described, represents a view in cross section of this same closure kit, FIG. 3, previously described, represents a view in perspective, partially exploded, of a cursor according to the prior art, FIGS. 4 and 5, previously described, represent two views in section of a closure kit fitted with such a cursor along two planes numbered IV-IV and V-V in FIG. 3, FIG. 6 represents a view in cross section of a closure kit according to the present invention at the tapered end of the sole, and FIGS. 7 to 12 represent similar cross-sectional views of 6 variants according to the present invention.

DETAILED DESCRIPTION OF THE INVENTION

The present invention may find application in any type of bag. For this reason, the description that follows will not give details of the means of producing the bag itself, or of its or their constituent materials.

The same will apply for the closure profiled elements 200, 250. They are not limited to the geometry represented in the appended figures. These profiled elements may be of the complementary male/female type, of the complementary hook type, of the complementary hook/loop fabric type, or any other equivalent structure. They may be made of any appropriate material. The closure profiled elements 200, 250 may be made of the same material as the walls of the bag, for example extruded or fitted and attached to the walls of the bag by any appropriate means.

Similarly, the general structure of the cursor 100 and its constituent material will not be described in detail hereinafter. Particular attention will be paid to describing the essential feature of the invention.

The cursor 100 may be made of metal or plastic. It comprises a base 110, two side plates 120, 130 and a central wall 140 which supports a sole 142. The side plates 120, 130 and the central wall 140 together define two channels 150, 160 at least partly nonparallel.

As previously indicated, according to the invention, at least one of the two complementary elements 200, 250 of the closure kit has a structure 210 forming a stop for the sole 142.

Preferably, in the context of the invention, this structure 210 forming a stop:

- has a concavity directed toward the inside of the bag, and/or
- defines at least one surface which converges toward its supporting wall in the direction of the outside of the bag and/or
- defines at least one longitudinal rib used for coupling to the sole in the case of an attempt to tear it off.

FIG. 6 shows such a structure 210 forming a stop that is of generally concave rounded shape on one of the closure profiled elements 200 facing a complementary convex rounded geometry formed on the sole 142.

Figure 7:
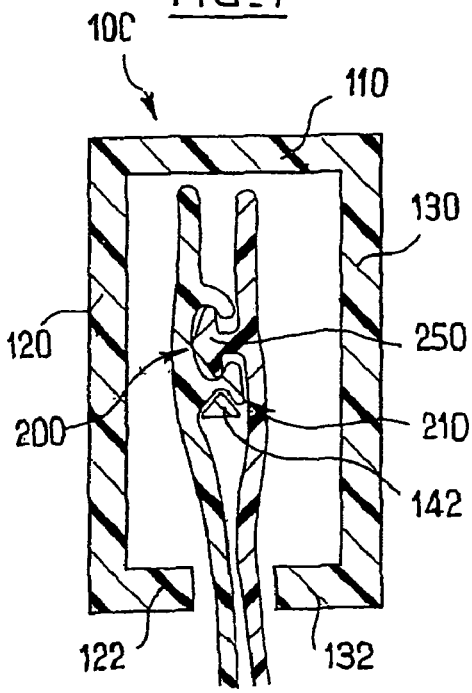

FIG. 7 shows a similar arrangement in which the structure 210 has the general shape of a concave dihedral facing a convex dihedral formed on the sole 142.

Those skilled in the art will understand that if there is an attempt to tear off the cursor, the sole 142 butts against the structure 210 and prevents the cursor from being pulled off.

Figure 8:
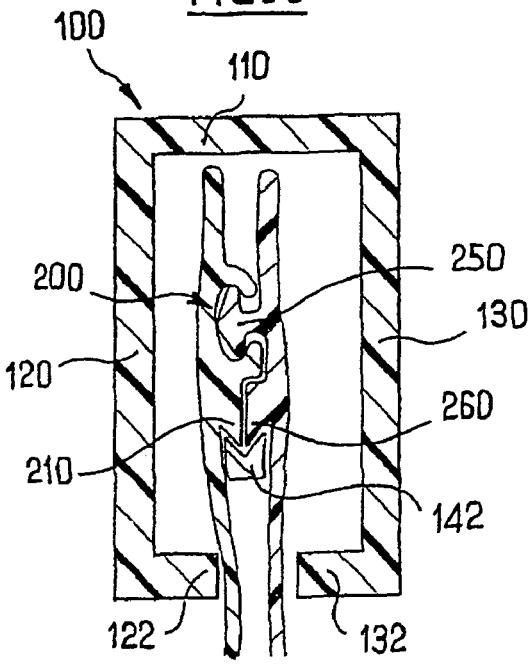

FIG. 8 shows a variant according to which surfaces forming a stop are formed respectively on the two closure elements 200, 250, with reference numbers 210, 260. The sole 142 defines a complementary concave dihedral.

Those skilled in the art will understand that this arrangement enhances security. Specifically, any tearing force exerted on the cursor 100 tends to bring the closure profiled elements 200, 250 closer together and not separate the latter.

Figure 9:
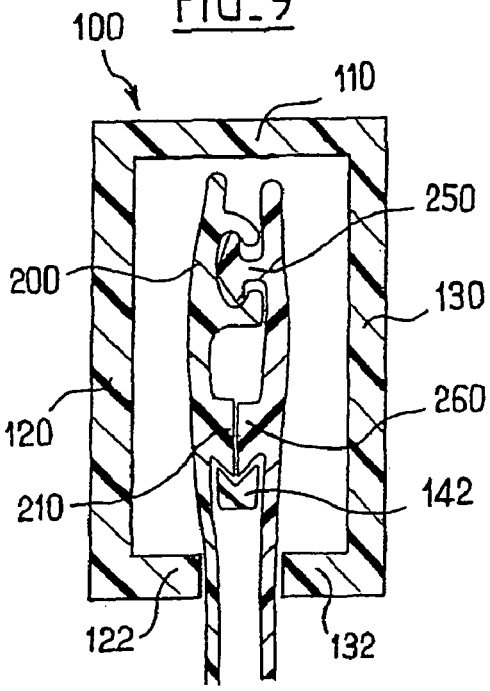

FIG. 9 shows a variant according to which the structures forming a stop are independent of the closure profiled elements themselves. This arrangement may apply to all the variants according to the invention.

Figure 10:
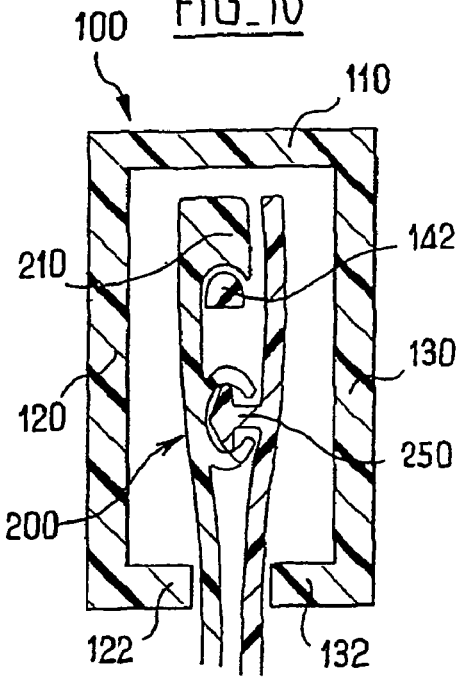
Figure 11:
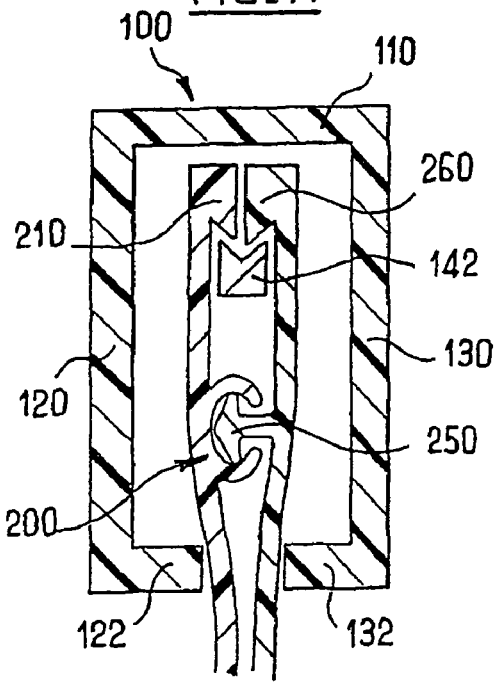

Finally, FIGS. 10 and 11 show two variants according to which the structures forming a stop are provided on the external side of the closure profiled elements 200, 250. This arrangement prevents the wall 140 and the associated sole 142 from passing between the closure profiled elements 200, 250. In consequence, it provides the seal.

Figure 12:
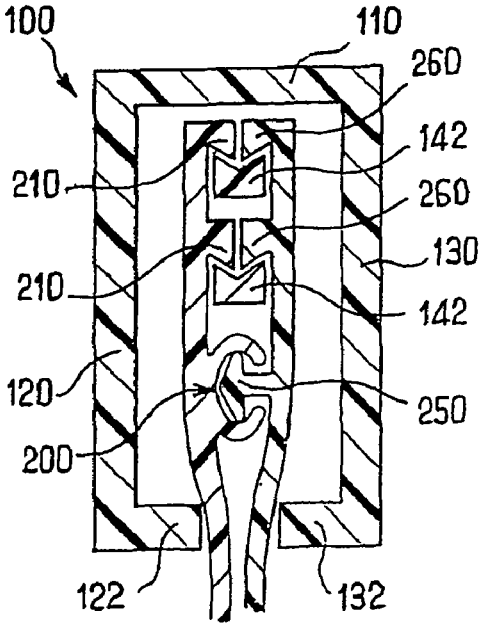

FIG. 12 shows a variant embodiment according to which several levels of means forming a stop 210, *260 are provided respectively facing several associated levels of the sole 142. Here again, this arrangement can apply to all the variants of the present invention.

Naturally, the present invention is not limited to the particular embodiments that have just been described but extends to any variant complying with the spirit thereof.

The invention claimed is:

1. A closure kit comprising two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) facing the sole that is concave toward the inside of a bag using the closure kit for forming a covering stop for the sole (242) in order to prevent the cursor (100) being pulled off under the effect of a tearing action, said covering stop and said sole having complementary shapes, wherein the base (110) and the two side plates (120, 130) define a recess wherein the sole (142) and the central wall (140) are arranged such that the sole (142) and the central wall (140) are completely covered by the base (110) and the two side plates (120, 130).

2. The kit as claimed in claim 1, characterized in that the structure forming a stop (210, 260) is formed on an element separate from the complementary elements (200, 250).

3. The kit as claimed in claim 1, wherein said structure of at least one of the two complementary elements has the general shape of a concave dihedral facing a convex dihedral formed on the sole (142).

4. A bag furnished with a closure kit, wherein the closure kit comprises two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) facing the sole that is concave toward the inside of a bag using the closure kit for forming a covering stop for the sole (242) in order to prevent the cursor (100) being pulled off under the effect of a tearing action, said covering stop and said sole having complementary shapes, wherein the base (110) and the two side plates (120, 130) define a recess wherein the sole (142) and the central wall (140) are arranged such that the sole (142) and the central wall (140) are completely covered by the base (110) and the two side plates (120, 130).

5. A closure kit comprising two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) facing the sole that is concave toward the inside of the bag for forming a covering stop for the sole (242) in order to prevent the cursor (100) being pulled off under the effect of a tearing action, wherein only one of the two complementary elements (200, 250) has a structure (210) forming a stop, said covering stop and said sole having complementary shapes, wherein the base (110) and the two side plates (120, 130) define a recess wherein the sole (142) and the central wall (140) are arranged such that the sole (142) and the central wall (140) are completely covered by the base (110) and the two side plates (120, 130).

6. A closure kit comprising two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) facing the sole that is concave toward the inside of a bag using the closure kit for forming a covering stop for the sole (242) in order to prevent the cursor (100) being pulled off under the effect of a tearing action, said covering stop and said sole having complementary shapes, wherein the sole (142) has a surface that is convex toward an outside of the bag, wherein the base (110) and the two side plates (120, 130) define a recess wherein the sole (142) and the central wall (140) are arranged such that the sole (142) and the central wall (140) are completely covered by the base (110) and the two side plates (120, 130).

7. A closure kit comprising two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) facing the sole that is concave toward the inside of the bag for forming a covering stop for the sole (242) in order to prevent the cursor (100) being pulled off under the effect of a tearing action, wherein the sole (142) has a surface that is convex toward an outside of the bag at a tapered end of the bag, wherein the structure forming a stop (210, 260) is formed on an outside of the complementary elements (200, 250) to allow a sealed closure with no element penetrating between these complementary elements, said covering stop and said sole having complementary shapes, wherein the base (110) and the two side plates (120, 130) define a recess wherein the sole (142) and the central wall (140) are arranged such that the sole (142) and the central wall (140) are completely covered by the base (110) and the two side plates (120, 130).

8. A closure kit comprising two complementary elements (200, 250) capable of being successively engaged and separated, and a cursor (100) comprising a base (110), two side plates (120, 130), a central wall (140) and a sole (142) connected to the central wall (140), characterized in that at least one of the two elements (200, 250) has a structure (210, 260) that is concave toward the inside of a bag using the closure kit forming a covering stop for the sole (242) in order to prevent the cursor (100) being pulled off under the effect of a tearing action, wherein the structure forming a stop (210, 260) comprises several levels respectively associated with a multi-level sole (142), wherein the base (110) and the two side plates (120, 130) define a recess wherein the sole (142) and the central wall (140) are arranged such that the sole (142) and the central wall (140) are completely covered by the base (110) and the two side plates (120, 130).

9. A closure kit comprising two complementary elements (200, 250) capable of being successively engaged and separated, and a cursor (100) comprising a base (110), two side plates (120, 130), a central wall (140) and a sole (142) connected to the central wall (140), characterized in that each one of the two elements (200, 250) has a structure (210, 260) that is concave toward the inside of a bag using the closure kit for forming a covering convex stop for the sole (242) in order to prevent the cursor (100) being pulled off under the effect of a tearing action, said covering convex stop being constituted by said two structures, wherein the sole has a surface that is concave toward the outside of the bag and that is complementary to the covering convex stop for the sole (242) constituted by said two structures, wherein the base (110) and the two side plates (120, 130) define a recess wherein the sole (142) and the central wall (140) are arranged such that the sole (142) and the central wall (140) are completely covered by the base (110) and the two side plates (120, 130).

* * * * *